US005082462A

United States Patent [19]

Oswald, Jr.

[11] Patent Number: 5,082,462

[45] Date of Patent: Jan. 21, 1992

[54] RIBBED TERMINAL HAVING PIN LEAD-IN PORTION THEREON

[75] Inventor: Joseph A. Oswald, Jr., Mechanicsburg, Pa.

[73] Assignee: E. I. Du Pont de Nemours and Company, Wilmington, Del.

[21] Appl. No.: 592,171

[22] Filed: Oct. 9, 1990

Related U.S. Application Data

[63] Continuation of Ser. No. 281,425, Dec. 8, 1988, abandoned.

[51] Int. Cl.[5] ..... H01R 11/22

[52] U.S. Cl. ..... 439/851; 439/380

[58] Field of Search ..... 439/842, 843, 851-858, 439/249, 252, 380, 381

[56] References Cited

U.S. PATENT DOCUMENTS

| | | | |
|---|---|---|---|
| 2,499,296 | 2/1950 | Buchanan | 137/328 |
| 2,499,297 | 2/1950 | Buchanan | 173/328 |
| 2,758,290 | 8/1956 | Watts | 399/91 |
| 2,763,848 | 9/1956 | Tuchel | 339/258 |
| 2,816,275 | 12/1957 | Hammell | 339/273 |
| 2,822,529 | 2/1958 | Heath | 339/258 |
| 2,866,174 | 12/1958 | Gorike | 339/262 |
| 3,128,143 | 4/1964 | Sitzler | 339/223 |
| 3,169,817 | 2/1965 | McKee | 339/256 |
| 3,183,471 | 5/1965 | Burkert | 339/95 |
| 3,262,087 | 7/1966 | Mancini | 339/256 |
| 3,348,192 | 10/1967 | De Vito | 439/853 |
| 3,409,863 | 11/1968 | Culver | 339/217 |
| 3,439,316 | 4/1969 | Evans | 439/853 |
| 3,539,965 | 11/1970 | Morehart et al. | 439/857 |
| 3,573,717 | 4/1971 | Lightner | 339/176 |
| 3,573,718 | 4/1971 | Lightner | 339/176 |
| 3,631,373 | 12/1971 | Matrisian | 339/17 C |
| 3,763,460 | 10/1973 | Hatschek | 339/89 M |
| 3,958,859 | 5/1976 | Schmid | 339/217 S |
| 4,076,356 | 2/1978 | Tamburro | 339/17 C |
| 4,445,747 | 5/1984 | Neidich | 349/256 R |
| 4,545,638 | 10/1985 | Neidich | 439/723 |

FOREIGN PATENT DOCUMENTS

| | | | |
|---|---|---|---|
| 365003 | 5/1979 | Austria . | |
| 343712 | 11/1921 | Fed. Rep. of Germany . | |
| 819266 | 10/1951 | Fed. Rep. of Germany . | |
| 965506 | 6/1957 | Fed. Rep. of Germany . | |
| 1023107 | 1/1958 | Fed. Rep. of Germany . | |
| 1465682 | 12/1964 | Fed. Rep. of Germany . | |
| 2224851 | 5/1972 | Fed. Rep. of Germany . | |
| 2148805 | 4/1973 | Fed. Rep. of Germany . | |
| 2524346 | 12/1976 | Fed. Rep. of Germany | 439/851 |
| 2615820 | 10/1977 | Fed. Rep. of Germany . | |
| 2708753 | 7/1978 | Fed. Rep. of Germany . | |
| 811272 | 4/1937 | France . | |
| 960968 | 4/1950 | France . | |
| 1009831 | 6/1952 | France . | |
| 1319621 | 4/1962 | France . | |
| 1575700 | 12/1968 | France . | |
| 313823 | of 0000 | Japan . | |
| 58395 | 9/1952 | Japan . | |
| 357101 | 11/1961 | Switzerland . | |
| 378967 | 6/1964 | Switzerland . | |
| 377390 | 7/1973 | U.S.S.R. . | |
| 239345 | 8/1924 | United Kingdom . | |
| 684143 | 12/1952 | United Kingdom . | |
| 1000223 | 8/1961 | United Kingdom . | |
| 993266 | 4/1962 | United Kingdom . | |
| 1153508 | 5/1969 | United Kingdom . | |
| 1288757 | 9/1972 | United Kingdom . | |
| 2000388 | 1/1979 | United Kingdom | 439/852 |
| 2130814 | 6/1984 | United Kingdom | 439/853 |

OTHER PUBLICATIONS

Du Pont Rib-Cage Connector System, Bulletin 2800, Dec. 1984.

Du Pont Rib-Cage Through-and Surface-Mount Vertical Card Connectors, Bulletin 2802, Dec. 1985.

Du Pont Connector Systems, Bulleting PL2800, Dec. 1986, "Rib-Cage 0.050 in. Center Connector Products".

Du Pont Pin Grid Array Hand Tool Model 144, Application Tool Information Sheet, Feb. 1985.

Operating Instructions for Du Pont Ht-144 Hand Tool Bulletin, 2/85.

Du Pont Connector Systems Bulletin, "Big Performance, Little Package," 10/86.

Rib Cage Connector System Bulletin, by Douglas A. Neidich.

0.050" Center Line, Surface Mountable Card Connector Bulletin, by Douglas A. Neidich.

*Primary Examiner*—David L. Pirlot

[57] ABSTRACT

Each of the forward ribs of a rib cage terminal is provided with a tab at the free end thereof. The tabs are provided with a chamfered surface to define a lead-in at the forward end of the terminal.

2 Claims, 7 Drawing Sheets

10
17L
16A
40
62
51L
55A
58
T
T min.
55B
D
$P_A$
40A
63
$P_D$
M
P
12A
12
17L
16B

RIBBED TERMINAL HAVING PIN LEAD-IN PORTION THEREON

This application is a continuation of application Ser. No. 07,281,425 filed Dec. 8, 1988 now abandoned.

BACKGROUND OF THE INVENTION

1. Field of the Invention

The present invention relates to a female terminal of the ribbed type and, in particular, to a ribbed terminal having a pin lead-in portion.

2. Description of the Prior Art

U.S. Pat. Nos. 4,545,757 and 4,545,638, both to Neidich and both assigned to the assignee of the present invention, disclose and claim a female connector having terminals of the ribbed type. Such a terminal is used in a connector which is manufactured and sold by E. I. Du Pont de Nemours and Company, Incorporated under the Trademark RIB-CAGE TM. This terminal has a central spine from which extends one or more pairs of cantilevered beams. The beams in each pair may be angled forwardly or rearwardly (that is, toward or away the input end of the terminal) and are formed into a structure generally reminiscent of a human rib cage. The ribbed structure defines a generally enclosed opening. The terminal is itself received in a cavity formed in a housing. The housing may have chamfered lead-in portions which serve to guide a pin into the cavity and into the opening defined by the rib cage.

While such a ribbed terminal is an effective connecting mechanism, relatively high insertion forces may be required to insert the pin into the terminal. FIG. 1 graphically illustrates the magnitude of pin insertion force as a function of insertion distance into a connector having a ribbed terminal, wherein the terminal has two bridged pairs of rearwardly extending ribs. The insertion distance is measured with respect to a reference line R that extends perpendicular to the axis of the opening of the terminal and which contains the forward most extremity of the terminal. The location of the reference line R for a connector having a ribbed terminal therein is shown in FIG. 9.

As seen in FIG. 1 there is associated with a terminal as is available in the art a contact lag distance (Distance A, extending from the reference line R to the point $d_1$ on FIG. 1). The contact lag distance is the distance the pin must be displaced inwardly from the reference line R until a portion of the pin (in the case of the prior art terminal, a portion of the tip of the pin) first encounters the ribs of the terminals. This point marks the location where continued forward displacement of the pin would begin to open the ribs. Because the diametrical (or diagonal) dimension of the major portion of the pin is greater than the dimension of the opening in the rib cage the major portion of the pin remains on the outside of the terminal opening during an initial phase of insertion (Distance B, between the points $d_1$ to $d_2$). The insertion force during this phase acts to spread apart the ribs of the terminal, but owing to the relatively poor pressure angle that the tip of the pin occupies with respect to the ribs a relatively high peak insertion force is required before the cage is spread sufficiently to accommodate the pin. Since this force is transmitted to an resisted by the spine of the terminal the column strength of the spine must be of sufficient to withstand this force without buckling. Moreover, if the spine is made thicker or wider it becomes less flexible, thus limiting its ability to move within the housing to accommodate normal misalignments between the pin and the terminal.

Once the peak force is reached the full diameter portion of the pin is abruptly received into the opening of the terminal. Thereafter the level of insertion force required to insert the pin should be relatively constant and is related primarily to the friction force between the pin and the ribs of the terminal (Distance C, between points $d_2$ to $d_3$ on the graph of FIG. 1). It should be noted that once the peak insertion force is reached the plot of insertion force versus distance would be expected to drop precipitously, as indicated by the cross portion of the trace in FIG. 1. However, in practice it may occur that the spine may bend and disorient the terminal within the connector housing. Due to this disorientation a higher than expected insertion force may be required in the Distance C, as is indicated by the solid line on the graph of FIG. 1.

During retraction of the pin (Distance D, between points $d_3$ to $d_4$ on the graph of FIG. 1) the magnitude of the withdrawal force (acting in a direction opposite the insertion force) should decrease. This is understandable since friction is again the primary force which must be overcome to withdraw the pin and the normal force exerted on the pin by the terminal would decrease as the pin is withdrawn from the terminal. The artifact (Distance E, between points $d_4$ to $d_5$ on the graph of FIG. 1) is believed due to the terminal acting to affirmatively expel the pin from the interior thereof as the tip of the pin is reached, analogous to the high peak insertion force required on entry.

The requirement of the relatively high peak insertion force for a given pin, when multiplied over a relatively large number of pins (as those disposed in a multi-pin header) may be difficult to achieve manually. As a result, the use of auxiliary equipment may be required or the number of pins available in a header may be limited. Accordingly, in view of the foregoing it is believed advantageous to provide a terminal of the ribbed type that includes a lead-in portion on the terminal itself to reduce the insertion force required to introduce a pin thereinto.

SUMMARY OF THE INVENTION

The present invention relates to a terminal of the ribbed type and in particular to ribbed terminal having a pin lead-in portion thereon, and to a connector having such a terminal therein. The terminal has a spine having an axis therethrough. At least one pair of ribs extends from the spine. Each of the ribs is angled with respect to the spine of the terminal. Each rib has an end thereon. The ribs are formed into a rib cage structure generally enclosing a pin receiving opening. The pin receiving opening has an axis extending therethrough. When formed into the rib cage structure the ends of the ribs are disposed closely adjacent respect to each other. The ribs are, when formed into the rib cage structure, movable from a first, relaxed, position to a second, operative, position.

The pin receiving opening has an axis therethrough and a predetermined dimension D associated therewith. The axes of the pin receiving opening and the spine are generally parallel to each other and lie in a predetermined reference plane. The pin receiving opening is adapted to receive therein a pin having a major portion with a predetermined diametrical or diagonal dimension $P_D$.

In accordance with the present invention a planar surface is disposed at the end of each of the ribs. The planar surfaces cooperate with each other to define a lead-in portion for a pin insertable into the opening in the terminal. The lead-in portion has a predetermined throat dimension T measured in a plane perpendicular to the reference plane. The magnitude of the throat dimension is related to the diametrical or diagonal dimension $P_D$ of the major portion of the pin P, and to the orientation that the pin occupies with respect to the terminal as the pin is inserted thereinto.

The ribs may be either angled either forwardly or rearwardly, that is, they may be angled toward or away from, respectively, the input end of the terminal. In the former case, the ends of the ribs are provided with tabs on which the surfaces defining the lead-in portion are formed.

The connector comprises a housing having a cavity formed therein, the cavity receiving a terminal having the lead-in portion thereon.

BRIEF DESCRIPTION OF THE DRAWINGS

The invention will be more fully understood from the following detailed description thereof, taken in connection with the accompanying drawings, which form a part of this application and in which.

DETAILED DESCRIPTION OF THE INVENTION

Figure 1:
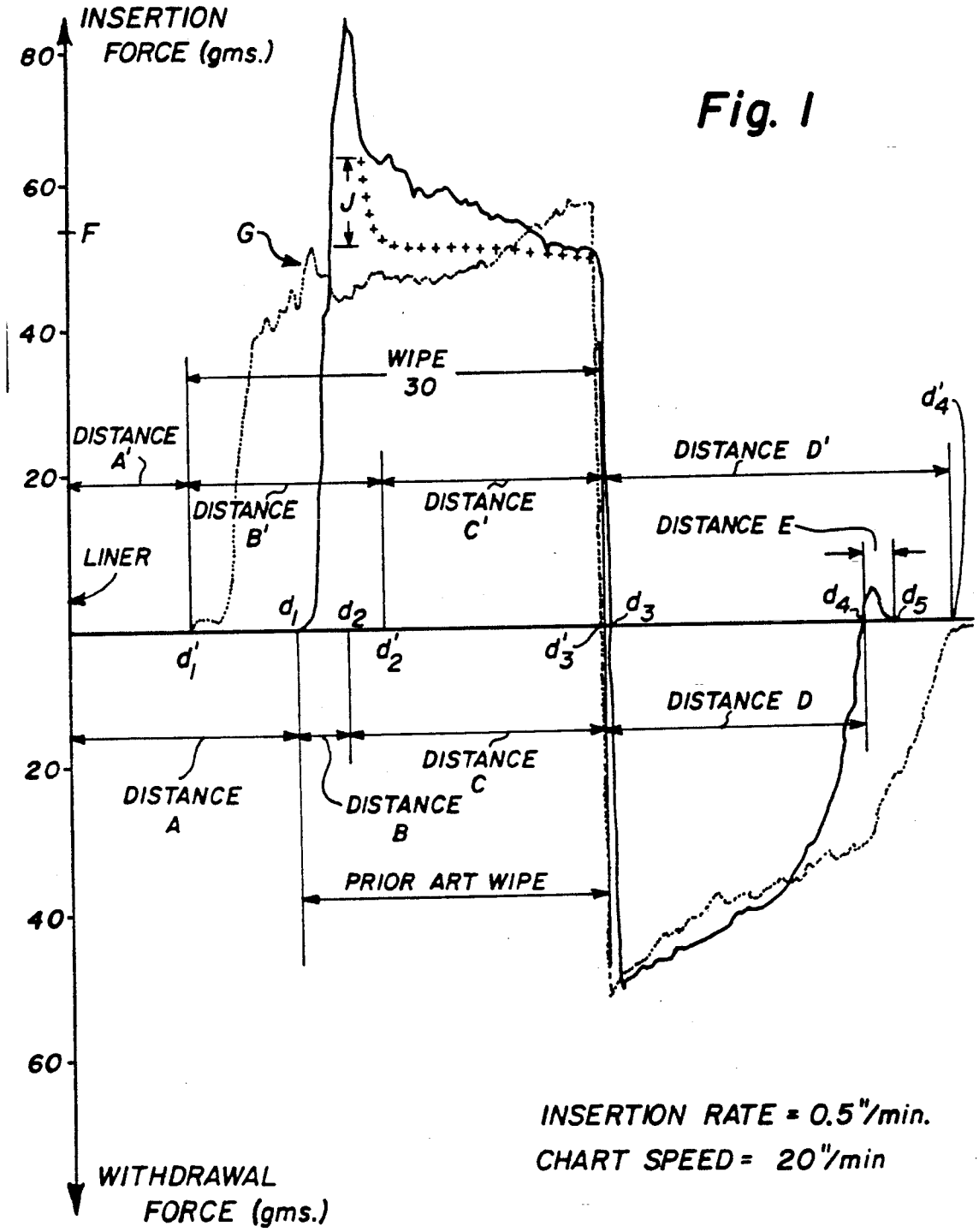
FIG. 1 is a graphical representation of the required pin insertion force for a ribbed terminal of the prior art and for a ribbed terminal in accordance with the present invention.

Throughout the following detailed description similar reference numerals refer to similar elements in all FIGURES of the drawings.

Figure 2:
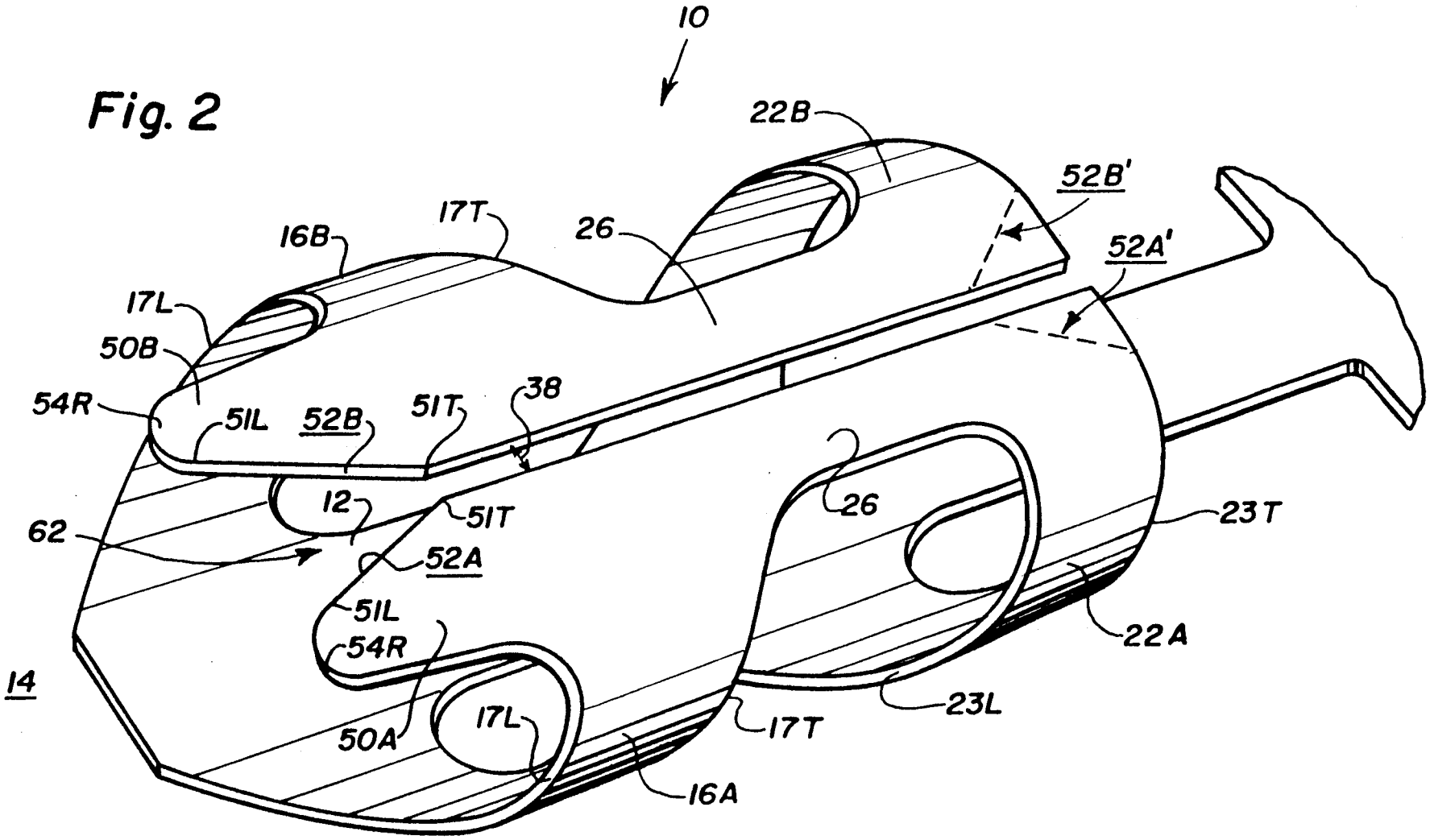
FIGS. 2 and 3 are, respectively, a perspective and a front elevational view of a formed ribbed terminal having a lead-in in accordance with the present invention.
Figure 3:
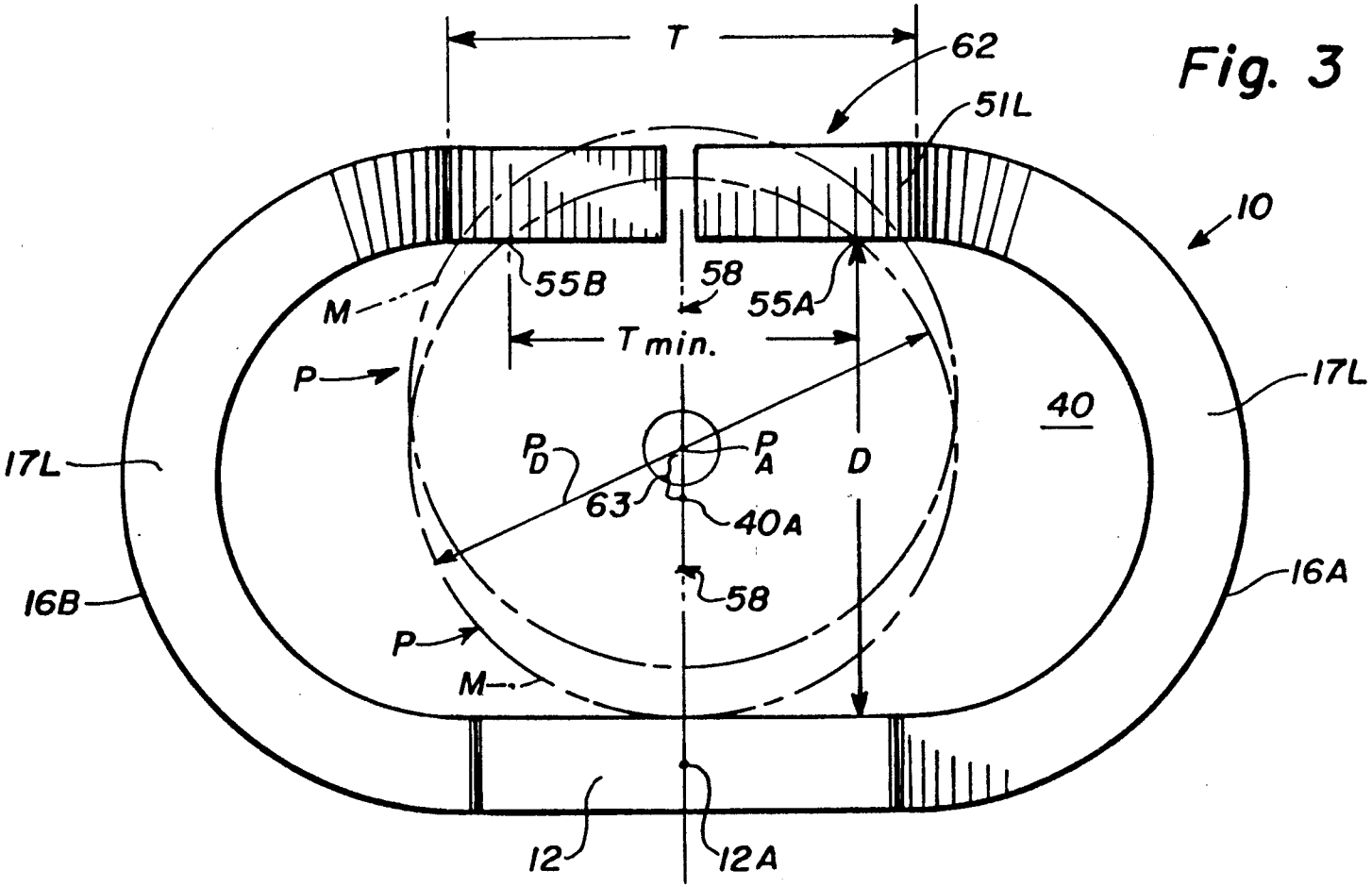
Figure 4:
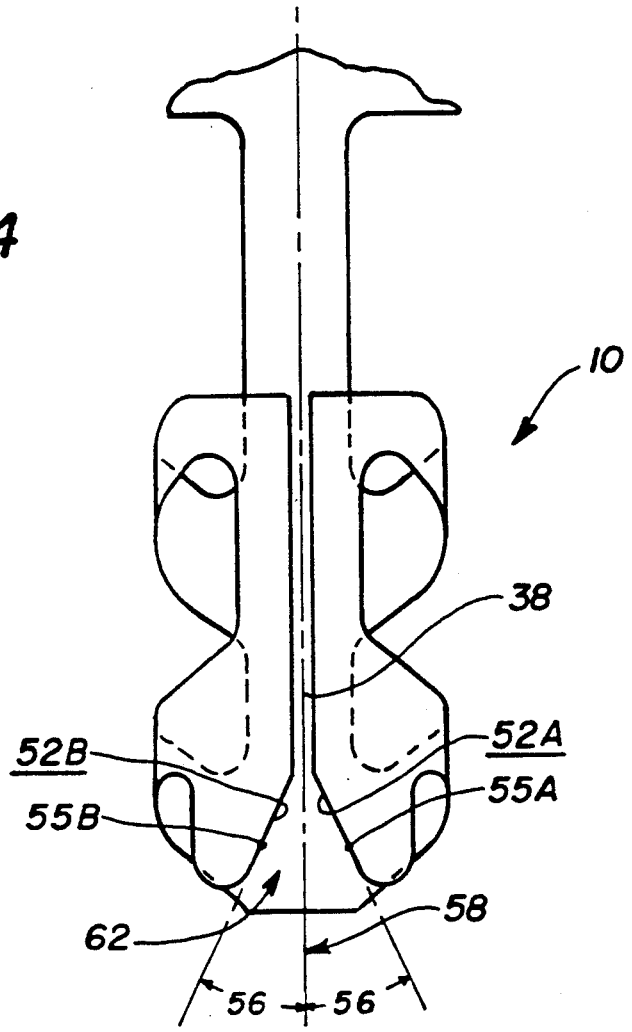
FIG. 4 is a plan view of the ribbed terminal shown in FIG. 3 illustrating the location of the reference plane.

With reference to FIGS. 2 through 5, respectively shown are a perspective, a front elevation, a plan and a developed view of a ribbed terminal generally indicated by reference character 10 in accordance with the present invention. It should be appreciated by those skilled in the art that the developed view shown in FIG. 5 corresponds to a plan view of a blank from which a terminal as that shown in FIGS. 2 to 4 is formed. The terminal 10 may be used without a housing in any desired mounting configuration, or may be used in a connector such as in a single entry or dual entry connector, or a vertical through mount or vertical surface mount connector. The ribbed terminal is generally similar to that disclosed and claimed in U.S. Pat. Nos. 4,545,757 and 4,545,638, both to Neidich and both assigned to the assignee of the present invention. Both of these last-mentioned patents are hereby incorporated by reference herein.

The terminal 10 has a central spine 12 having an axis 12A therethrough. The terminal 10 is formed from any metal commonly used to manufacture electrical terminals, such as phosphor-bronze, beryllium-copper, cupro-nickel, plated with a suitable conductor material, e.g., gold, tin or tin alloy. Of course, other suitable materials may be used if desired. Near a first, input, end 14 of the terminal 10 a first pair of ribs 16A, 16B extend outwardly from each lateral edge of the spine 12. The ribs 16A, 16B are shown in the preferred instance as being angled rearwardly from the input end 14 of the terminal but they may, as will be discussed, angle forwardly toward the input end 14 of the terminal 10 and remain within the contemplation of the invention.

The ribs 16A, 16B are disposed axially along the spine 12 in direct opposition to each other but they may, as will also be discussed herein, be axially offset if desired. Each of the ribs 16A, 16B has a leading edge 17L and a trailing edge 17T formed thereon, with both the leading edge 17L and the trailing edge 17T being at a predetermined angle 18L, 18T (FIG. 5) with respect to the axis 12A of the spine 12. Preferably the angle 18L is on the order of fifty degrees (50°) while the angle 18T is on the order of fifty five degrees (55°), whereby a tapered configuration is imparted to the ribs 16 as they extend from the spine 12. Forming the ribs in a tapered beam configuration is preferred over a nontapered beam configuration for stress distribution purposes. The line of the leading edges 17L and trailing edges 17T of the ribs 16 are extended, as indicated by the dashed lines in FIG. 5, for definitional purposes.

It should also be understood that the terminal 10 may, if desired, include additional pairs of ribs disposed behind the ribs 16A, 16B. To this end one additional set of ribs 22A, 22B is shown spaced a predetermined distance 24 from the first set of ribs 16. Further additional pairs of ribs may be conveniently provided, if desired. Adjacent ribs on each side of the spine 12 are bridged, as at 26. The ribs 22A, 22B each have a leading edge 23L and a trailing edge 23T thereon. The edges 23L, 23T of the ribs 22B are also extended, as indicated by the dashed lines in FIG. 5. The trailing edges 17T of the ribs 16 are spaced the predetermined distance 24 from the leading edges 23L of the ribs 22. For purposes of manufacturability it is preferred that the leading edges 23T of the ribs 22 lie parallel to the trailing edges 17T of the ribs 16. Thus, the angle 25L is equal to the angle 18T. Also, by making these edges parallel, with one punch and corresponding change the ribs may be made wider or narrower, corresponding to higher or lower normal force, respectively, as the application may demand. The trailing edge 23T of the ribs 22 are also preferably tapered beams and are preferably inclined at an angle 25T on the order of sixty degrees (60°) with respect to the spine 12.

Each of the ribs 16 has a predetermined beam length 28 associated therewith. The beam length 28 is measured from the spine to the tip of the rib. In addition, a predetermined contact or wipe length 30 is defined for the terminal 10. The wipe length 30 is, as will be more precisely developed, that portion of the terminal 10 where occurs electrical contact between the terminal and the major diameter or diagonal portion of a pin introduced into the terminal 10. Since the terminal 10 shown in FIG. 5 has two pairs of ribs the wipe length 30 extends over the bridge 26 and includes some of the material of the ribs 22. In addition, the wipe length 30 also includes a portion of tabs 50A, 50B, which are provided on the ends of the ribs 16 for a purpose to be fully described herein. Since FIG. 5 also illustrates the blank from which the terminal 10 is formed, the blank may be connected by bridges to a carrier strip F. The carrier strip F has a pilot hole schematically shown at reference character H for later registration during forming.

The ribs 16A, 16B each have an end portion 34A, 34B, respectively, thereon. The ribs 16A, 16B are bent toward each other to place the end portions 34A, 34B in proximity to each other and to define a structure resembling a human rib cage. The ends of the ribs are gapped, as at 38 (FIG. 2). The structure formed by the bent ribs defines a pin receiving opening 40 having an axis 40A therethrough. The opening 40 has a predetermined opening D associated therewith. The dimension D is defined more fully herein. The ribs 16 are, when formed into the rib cage structure, movable from a first, relaxed, position to a second, operative, position. As noted above, the ribs are, in the preferred instance, angled rearwardly from the input end 14 of the terminal 10. By angling the ribs 16 rearwardly a sufficient beam length 28 may be imparted thereto to permit the ribs 16 of a terminal 10 manufactured from the above discussed materials, when the ribs 16 are in the operative position, simultaneously to provide a sufficient magnitude of normal force on a pin received in the opening of the formed terminal 10 with a moderate insertion force, and to permit plural terminals 10 to fit within a housing of a connector on fifty thousandth inch center spacing or smaller.

In the embodiment shown in the FIGURES the ends 34 of the ribs 16 are provided with tabs 50A, 50B, respectively thereon. Each of the tabs 50A, 50B is provided with a surface 52A, 52B, respectively. The tabs 50A, 50B are preferably chamfered to provide respective planar surface 52A, 52B that each extend between a leading edge 51L and a trailing edge 51T. Although the tabs 50A, 50B are chamfered to provide planar surfaces 52A, 52B in the preferred instance, it should be understood that they may be rounded, ovate, or otherwise configured.

Figure 6:
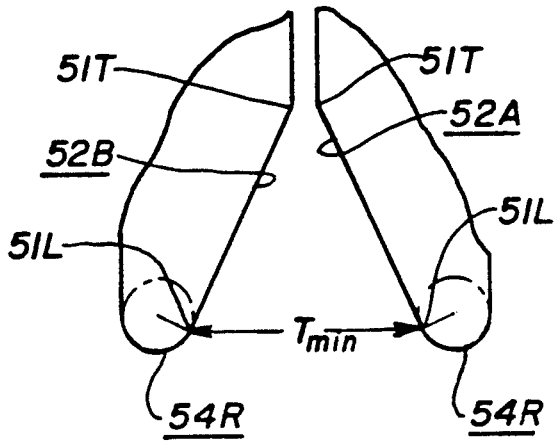
FIGS. 6 and 7 are, respectively, enlarged portions of the plan view of the connector shown in FIG. 4 and an alternate embodiment thereof illustrating the measurement of the throat dimension for a terminal in accordance with the present invention.
Figure 7:
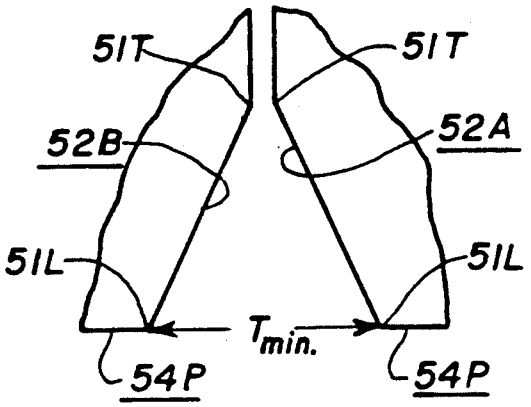
Figure 5:
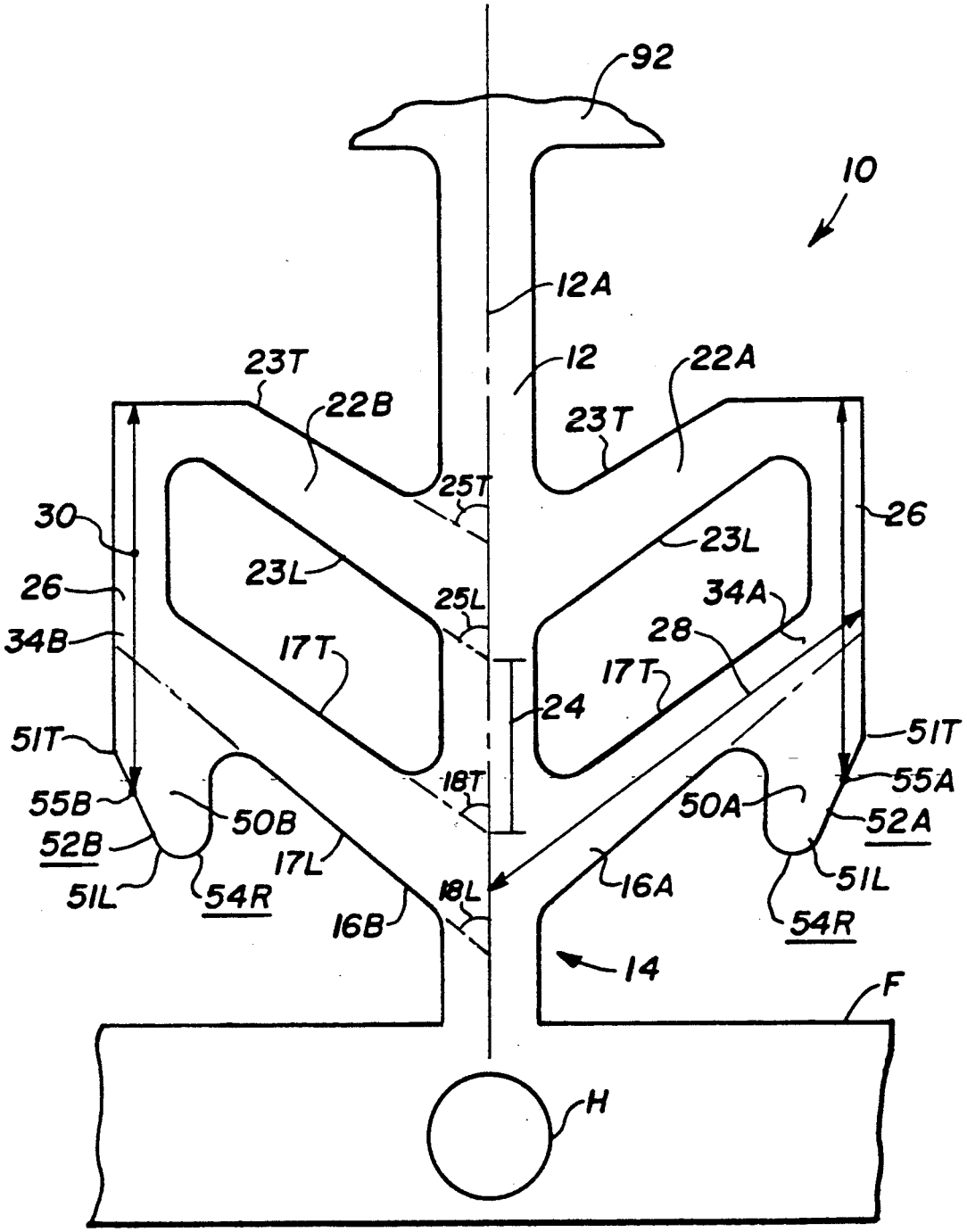
FIG. 5 is a developed view of a ribbed terminal in accordance with the present invention, such a developed view corresponding to a plan view of a blank from which a terminal as that shown in FIGS. 2 to 4 is formed.

The tips of the tabs 50A, 50B adjacent to the leading edges 51L of the surfaces 52A, 52B may be rounded, as shown at 54R in FIGS. 1 to 6, or they may, if desired, be formed as generally planar frontal surfaces 54P, as shown in FIG. 7. As will be explained herein, each planar surface 52A, 52B defines a predetermined angle 56 (FIG. 4) measured with respect to a reference plane 58. The plane 58 contains both the axis 12A of the spine 12 and the axis 40A of the opening 40. The reference plane 58 extends through the gap 38.

In accordance with the present invention the planar surfaces 52A, 52B of the respective tabs 50A, 50B cooperate to define a lead-in, generally indicated in the FIGURES at reference numeral 62, adjacent the input end 14 of the terminal 10. As seen in the front elevational view in the plane of FIG. 3 (which is a plane perpendicular to the reference plane 58), the lead-in 62 has a minimum throat dimension $T_{min}$ associated therewith. The minimum throat dimension $T_{min}$ is defined as the distance in a plane perpendicular to the reference plane 58 between the points 55A, 55B on the respective planar surfaces 52A, 52B where the major portion M of a pin P (which may be plated with materials similar to those on the terminal) inserted into the opening 40 along a pin axis $P_A$ first contacts the surfaces 52A, 52B. In order to achieve the desired normal force acting on the pin P the pin axis $P_A$ must be offset a predetermined distance 63 in the reference plane 58 from the axis 40A of the opening 40. In the minimum instance for the throat dimension, the points 55A, 55B are coincident with the leading edge 51L of the respective surface 52A, 52B.

As may be seen in connection with FIG. 6, when the planar surfaces 52A, 52B are adjacent to rounded rib tips 54R the throat $T_{min}$ is defined between the points 55 on each rib where the leading edge 51L of the planar surface 52 intersects the rounded tip of the tab of the rib. Alternately, if the tip of the rib is provided with planar frontal surfaces 54P (FIG. 7), then the throat dimension $T_{min}$ is defined between the point 55 on each rib where the leading edge 51L of the planar surface 52 intersects the edge of the planar surface 54P. If the surfaces 52 are other than planar, then the throat dimension $T_{min}$ is defined between corresponding leading edges 51L of the surfaces 52.

The minimum throat dimension $T_{min}$ may be defined in terms of the dimension D of the opening 40 and the diametrical (or diagonal) dimension $P_D$ of a pin P insertable into the opening 40. In addition, the orientation of the pin P with respect to the terminal 10 (e.g., the position in which the pin, when mounted in a header, occupies with respect to the terminal) would also play a part in determining the minimum throat dimension $T_{min}$.

A specific example of the manner in which the minimum throat dimension $T_{min}$ may be ascertained is now set forth. In the discussion that follows it is assumed that the pin P has a substantially round major portion M having a diameter $P_D$. The dimension D of the opening 40 is defined as the minimum distance, measured when a rib 16 is in the relaxed state, between the inner surface of the spine 12 and the point of intersection 55 of that rib and the full diameter major portion M of a pin P inserted into the opening 40, with the axis $P_A$ of the pin P being offset from the axis 40A of the opening 40 by the distance 63, such that the major portion M of the pin P is tangent to the inner surface of the spine 12. The offset distance 63 is equal to one-half the difference between the dimension D of the opening and the diameter $P_D$ of the pin P.

Using geometry, it can be shown in such a case that the minimum throat dimension $T_{min}$, measured in a plane perpendicular to the plane 58 (that is, the plane of FIG. 3), is equal to:

$$T_{min.}=2[P_D-D]\tfrac{1}{2} \qquad (1)$$

With the throat T at its minimum, the leading edge 51L of the surface 52 is coincident with the point 55 wherein the full diameter portion M of the pin P contacts the surface 52.

Figure 8A:
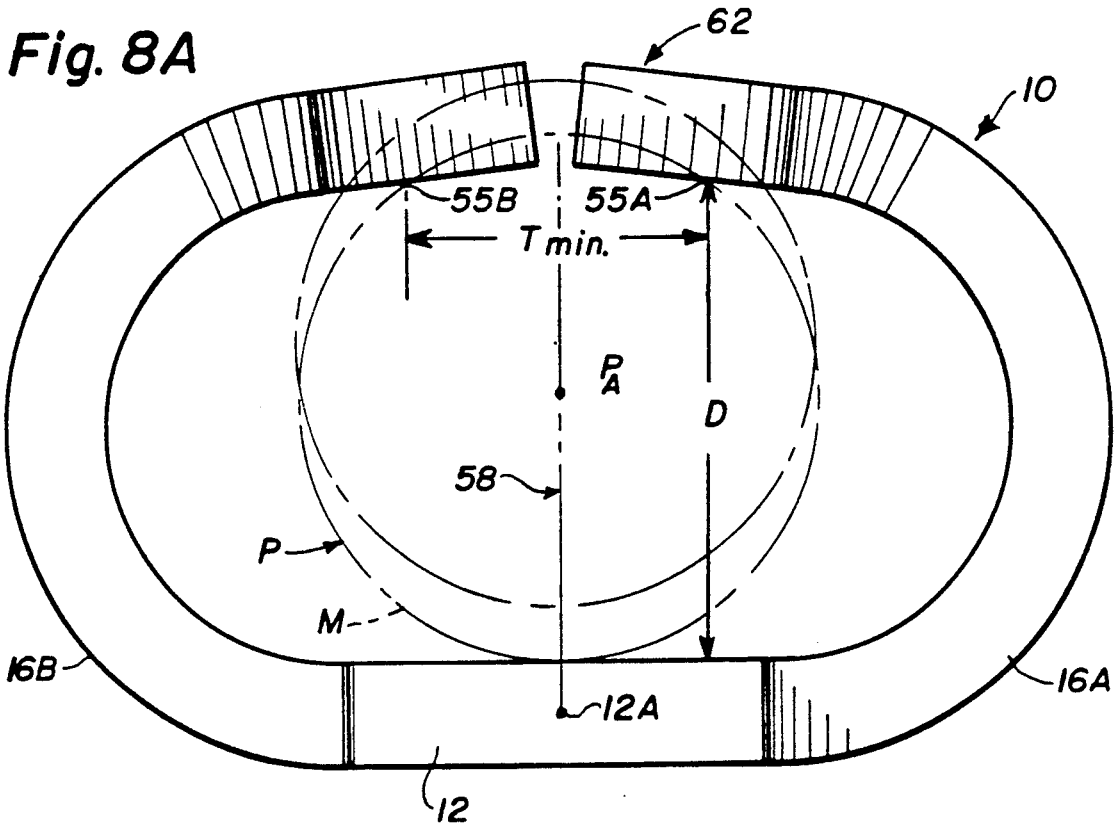
FIGS. 8A and 8B are, respectively, front elevational views similar to FIG. 3, illustrating the measurement of the throat dimension and the location of the dimension of the opening of a terminal in accordance with modifications of the present invention.
Figure 8B:
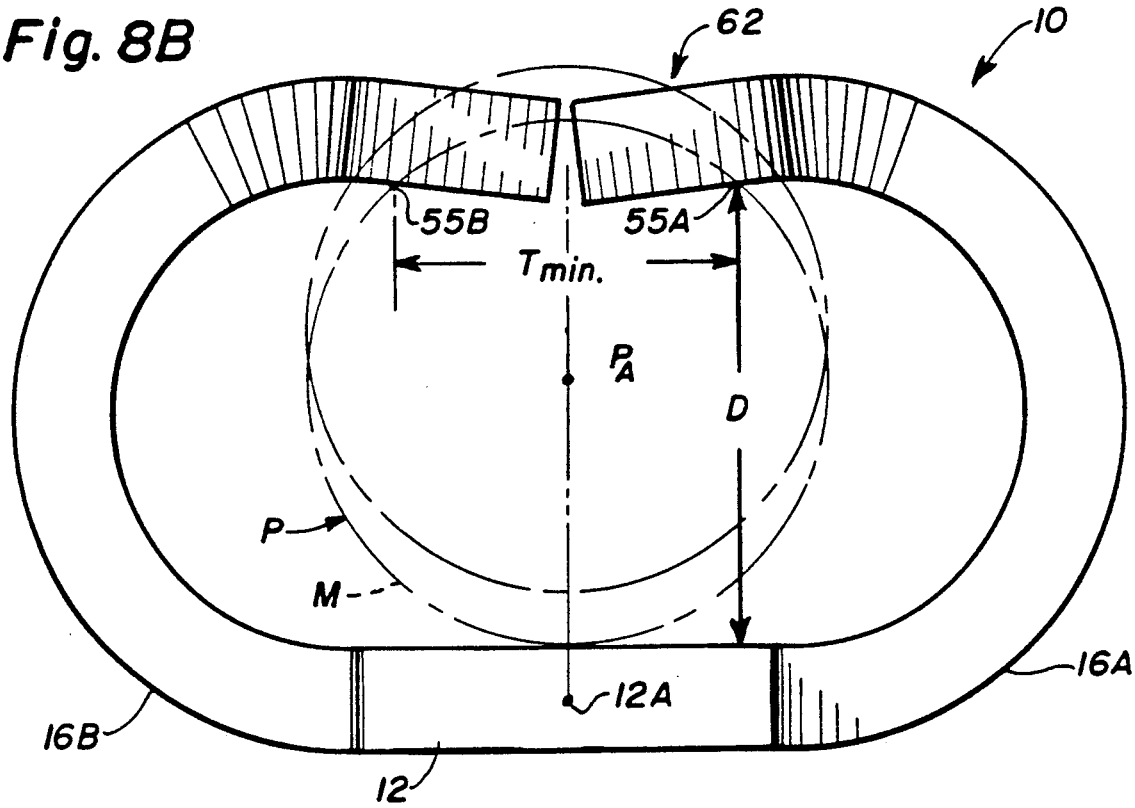

It should be understood that in the relaxed state the undersurface of the tip of the rib (when the terminal is formed) need not be parallel to the inner surface of the spine 12. As seen in FIGS. 8A and 8B, instances are illustrated for the specific example being discussed where, in the relaxed state, the undersurfaces of the ribs are not parallel to spine 12. The measurement of the dimension D of the opening 40 follows the same general rule given above. The same general formulation of the minimum throat dimension $T_{min}$ given in Equation (1) would apply.

The formulation of the minimum throat dimension $T_{min}$ for different pin shapes and different predetermined orientations of such pins with respect to the structure of the terminal would, of course, result in different formulations of the relationship between the dimension $P_D$ of the major portion M of the pin P and the opening 40 of the terminal 10.

It should also be noted that in accordance with the present invention the throat T can exhibit a greater dimension that the prescribed minimum distance $T_{min}$. In the case of the specific example being discussed the throat dimension satisfies the inequality:

$$T_{min} \geqq 2[(P_D - D)]^{\frac{1}{2}} \quad (1A)$$

By making the dimension of the throat larger than the prescribed minimum dimension, the axis $P_A$ of the pin P may lie anywhere within a predetermined zone 65 of possible locations within the plane in which the throat T is measured (i.e., the plane of FIG. 3) and still obtain the advantages of reduced insertion force.

The magnitude of the angle 56 between the reference plane 58 and the surfaces 52 is dependent upon a number of practical design considerations. The surfaces 52 must have a minimum angle that is great enough such that no part of the tip of the pin will touch any portion of the surface 52 before the full diameter portion of the pin engages the surface 52. This limitation will guarantee that the full diameter (or diagonal) of the pin acts on the surfaces 52 and the insertion force imposed on the pin acts radially thereof. If too small an angle is selected the required insertion force will approach an undesirable peak on pin entry. If too large an angle is selected the wipe of the terminal would be adversely affected. These considerations militate that an angle in the range from twenty-five to thirty degrees is preferred.

As noted earlier in the preferred embodiment illustrated in the Figures the ribs 16 are angled rearwardly on the spine 12. Accordingly, to define the surfaces 52 on such ribs it is preferred that each of the ribs 16 has the tab 50A, 50B, respectively, provided thereon at the end portions 34 thereof. The provision of the tabs 50 has the effect of increasing the beam length of the ribs, which is advantageous in that it effectively decreases the spring constant of the ribs as the pin contacts the tabs as the pin enters the terminal.

In the event the ribs 16 were angled forwardly on the terminal 10 the necessity of the tabs 50 would be obviated. If one assumes, for example, that the location of the input end of the terminal were reversed, the ribs 22 as shown in the Figures would, in such an event, define the leading pair of ribs. The surfaces 52 would then be defined on the ends of the ribs generally in the location indicated by the dashed lines 52A', 52B'. In practice, then, for the preferred configuration of rearwardly extending ribs, the tabs 50 add the necessary material at the ends 34 of the ribs on which to place the surfaces to define the lead-in for the pin in accordance with the invention. However, providing forwardly extending ribs may be useful in defining a lead-in at the opposite end of the terminal 10, thereby making the terminal adaptable to accept pins from either or both axial ends thereof.

It is also briefly noted above that the ribs may be axially offset from each other along the spine. In this event, for rearwardly angled ribs, if it is desired that the leaded tips of the ribs on each side of the spine align with each other along the axis 40A of the opening 40 of the terminal, then the tab on the rearward rib in the pair would be made longer than the tab on the forward rib in such a pair. Alternately, if forwardly extending ribs are axially offset, and if it is desired that the leaded tips of the ribs on each side of the spine align with each other along the axis 40A, the rearward one of the ribs would be provided with a tab. As yet another alternative within the contemplation of this invention, it may be desired that the tips of the ribs not align with each other, whether the ribs are forwardly or rearwardly extending and whether or not the ribs are axially offset. It is believed that all of the alternatives set forth in this paragraph, or any other configuration which would impart some asymmetry to the configuration of the terminal, are not to be preferred, since such configurations would impart asymmetric forces to the terminal. However, such configurations to the extent that they include a pin lead-in portion, are to be construed as encompassed within the contemplation of the present invention.

The advantage of the lead-in is believed best illustrated in connection with FIG. 1. It should be understood that the comparison to be discussed is taken using a terminal in accordance with the preferred embodiment of this invention in which it is desired to achieve substantially the same level F of insertion force on the pin as in the case of the prior art terminal, once the peak has occurred (i.e., the force at the end of the Distance C). It is noted that the insertion force F is related to the normal force by the coefficient of friction of the plating material on the surface of the ribs and on the surface of the mating pin.

As may be seen in FIG. 1 the contact lag distance (Distance A', between the reference line R and the point $d'_1$) is shorter than in the case of the prior art terminal, owing to the forwardly extending tab. It is noted that in the instance for the terminal in accordance with the present invention the contact lag distance is the distance from the reference line R at which the major portion M of the pin P first contacts the material of the terminal. As the pin is inserted into the terminal 10, during an initial insertion phase (Distance B', between the point $d'_1$ and the point $d'_2$) the insertion force required is less than that required by the prior art ribbed terminal. This reduction is believed due to the fact that the pin may act against the material of the tabs, and with a more advantageous pressure angle thereby provided, progressively urge the ribs 16 apart. The abrupt entry of the pin into the terminal experienced by the prior art terminal is eliminated and the force required to insert the pin ramps smoothly until the pin is within the cage, Distance C', in which only the frictional force is presented to the pin entry.

The terminal in accordance with the present invention provides an increased wipe distance 30 over a terminal of the prior art. Both of the wipe distances shown in FIG. 1 are the distances that the major portion of the pins are contacted by the terminal. As seen in FIG. 1 the wipe distance 30 for the terminal in accordance with the present invention is greater than the corresponding wipe distance for a prior art terminal.

The artifact (Distance E) present in the prior art ribbed terminal is not present in the terminal of the present invention. The artifact at G in FIG. 1 is believed due to the disorientation of the spine which results in a higher than expected insertion force, similar to the situation discussed earlier in connection with the prior art terminal (offset J shown in Distance C, between the solid line and the cross portion). It is believed that the magnitude of the artifact G is less than the offset effect J because the terminal in accordance with the present invention is believed disoriented to a lesser degree because of a lower maximum insertion force.

The plots of insertion force shown in FIG. 1 for both the prior art terminal and in terminal in accordance with the present invention were made using a standard steel gauge pins having a major diameter rounded portion and a narrower, lesser dimensioned spherical tip portion thereon. The pins were mounted on bearings for self-centering. The pin was lubricated using a lubricant such as a ten percent (10%) concentration of 176 Nye Oil in chlorethane, manufactured and sold by William F. Nye Inc., New Bedford, Mass. The prior art terminal, having an opening (D) of 0.0159 inches and fabricated from 0.0033 inch stock, was housed in a housing such as that sold by E. I. Du Pont de Nemours and Company, Incorporated under the Trademark RIBCAGE TM as part number 68822 while the gold plated terminal in accordance with the present invention was disposed in a corresponding housing made slightly larger to accommodate the wider terminal. The terminal in accordance with the present invention had an opening (D) of 0.0157 inches and was fabricated from 0.0033 inch stock. The force measurements were made using a measurement device as that manufactured and sold by Instron, Inc., under model number 1122.

Figure 9:
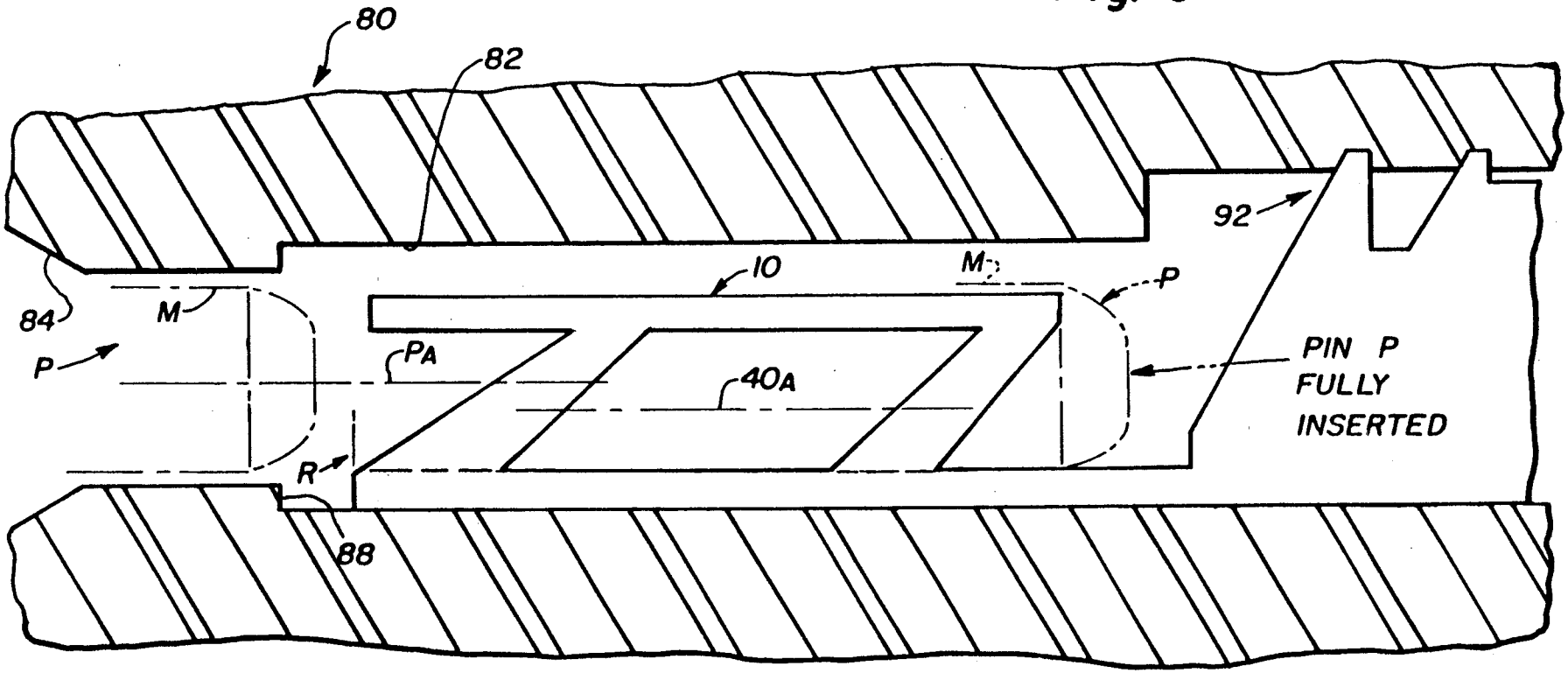
FIG. 9 is a side elevational view, entirely in section, illustrating a portion of a connector having a ribbed terminal in accordance with the present invention disposed therein.

As is seen from FIG. 9 the terminal 10 in accordance with the present invention may be used within a connector formed of a housing 80 having a terminal receiving cavity 82 therein. The terminal housing 80 may be manufactured from a suitable insulating material, such as the polyphenylfulfide plastic manufactured by Philips Petroleum and sold under the trademark RYTON ® or the polyester engineering thermoplastic resin manufactured and sold by E. I. Du Pont de Nemours and Company, Incorporated under the Trademark RYNITE ®. The housing 80 is provided with lead-in surfaces 84 to guide a pin into the cavity 82 along a pin entry axis 86. The cavity 82 in the housing 80 is undercut, as at 88, to offset further the axis 40A of the opening 40 of the terminal 10 from a predetermined desired entry axis $P_A$ for the pin P. The terminal 10 is staked, or otherwise suitable attached, as at 92, in the housing 80. In the preferred instance the pin should extend into the terminal such that tip of the pin P projects past the end of the terminal and that the major portion M of the pin is received within the terminal. The housing may be configured to facilitate the connecter's use as either a single entry or a dual entry connector, or as a vertical through mount or a vertical surface mount connector.

Those skilled in the art, having the benefits of the present invention as hereinabove set forth may effect numerous modifications thereto. It should be understood that these modifications are to be construed as lying within the contemplation of the present invention, as defined by the appended claims.

What is claimed is:

1. In a terminal having a spine with an axis extending therethrough, at least one pair of ribs extending from the spine, each of the ribs having a free end thereon, the free end of each rib having an undersurface thereon, the ribs being bent such that the free ends thereof are proximal to each other with a gap therebetween and the undersurfaces of the free ends are diametrically opposed to and spaced from the spine thereby to define a rib cage structure generally enclosing a pin receiving opening, the pin receiving opening having a predetermined axial length associated therewith and having an input end, each rib having a leading edge angularly disposed in a rearward direction away from the input end, the ribs being movable from a first, relaxed, position to a second, operative, position, in the first position the undersurfaces of the free ends of the ribs being spaced a first distance from the spine to impart to the pin receiving opening a constant dimension throughout its axial length, while in the second position the undersurfaces of the free ends of the ribs being spaced a second, greater, distance from the spine, the pin receiving opening being adapted to receive therein a pin having an exterior surface thereon so that when the pin is received in the terminal the rib cage structure surrounds the exterior surface of the pin with the pin in engagement with the spine, the improvement comprising:

each of the ribs having a forwardly extending tab thereon adjacent the input end of the pin receiving opening of the terminal, each tab having an angularly disposed edge surface thereon, the edge surfaces leading toward the gap, the edge surfaces axially confronting each other and cooperating to define a lead-in disposed adjacent to the input end of the pin receiving opening of the terminal and axially forwardly thereof for leading a pin inserted into the pin receiving opening in a direction parallel to the axis thereof, the edge surfaces defining the lead-in being responsive to contact with a pin to urge apart the free ends of the ribs from the relaxed toward the operative position as the pin is inserted into the terminal, thereby to facilitate the entry of the pin into the pin receiving opening.

2. A connector comprising:

a housing, the housing having a cavity therein; and a terminal disposed in the cavity of the housing, the terminal having a spine with an axis extending therethrough, at least one pair of ribs extending from the spine, each of the ribs having a free end thereon, the free end of each rib having an undersurface thereon, the ribs being bent such that the free ends thereof are proximal to each other with a gap therebetween and the undersurfaces of the free ends are diametrically opposed to and spaced from the spine thereby to define a rib cage structure generally enclosing a pin receiving opening, the pin receiving opening having a predetermined axial length associated therewith and having an input end, each rib having a leading edge angularly disposed in a rearward direction away from the input end, the ribs being movable from a first, relaxed, position to a second, operative, position, in the first position the undersurfaces of the free ends of the ribs being spaced a first distance from the spine to impart to the pin receiving opening a constant dimension throughout its axial length, while in the second position the undersurfaces of the free ends of the ribs being spaced a second, greater, distance from the spine, the pin receiving opening being adapted to receive therein a pin having an exterior surface thereon so that when the pin is received in the terminal the rib cage structure surrounds the exterior surface of the pin with the pin in engagement with the spine, each of the ribs having a forwardly extending tab thereon adjacent the input end of the pin receiving opening of the terminal, each tab having an angularly disposed edge surface thereon, the edge surfaces leading toward the gap, the edge surfaces axially confronting each other and cooperating to define a lead-in disposed adjacent to the input end of the pin receiving opening of the terminal and axially forwardly thereof for leading a pin inserted into the pin receiving opening in a direction parallel to the axis thereof, the edge surfaces defining the lead-in being responsive to contact with a pin to urge apart the free ends of the ribs from the relaxed toward the operative position as the pin is inserted into the terminal, thereby to facilitate the entry of the pin into the pin receiving opening.

* * * * *